US006514178B2

(12) United States Patent
Vettori

(10) Patent No.: US 6,514,178 B2
(45) Date of Patent: Feb. 4, 2003

(54) ARTIFICIAL CLIMBING STRUCTURE

(76) Inventor: Renzo Vettori, Via Della Terra, 42, I-38068 Rovereto (IT)

( * ) Notice: Subject to any disclaimer, the term of this patent is extended or adjusted under 35 U.S.C. 154(b) by 0 days.

(21) Appl. No.: 09/918,540

(22) Filed: Aug. 1, 2001

(65) Prior Publication Data

US 2002/0019297 A1 Feb. 14, 2002

(30) Foreign Application Priority Data

Aug. 4, 2000 (IT) ..... MI2000A1830

(51) Int. Cl.[7] ..... A63B 9/00; A63B 7/04

(52) U.S. Cl. ..... 482/37; 482/35; 482/36; 482/39

(58) Field of Search ..... 482/35–38, 148; 446/476; D21/811, 814, 820, 826; D25/149, 151

(56) References Cited

U.S. PATENT DOCUMENTS 4,259,821 A * 4/1981 Bush ..... 52/309
4,340,217 A * 7/1982 Gillis ..... 272/113
5,092,587 A * 3/1992 Ulner et al. ..... 272/112
5,125,877 A * 6/1992 Brewer ..... 482/7
5,543,185 A * 8/1996 Christensen ..... 482/15
5,549,195 A * 8/1996 Aulagner et al. ..... 198/850
5,941,041 A * 8/1999 Robinson et al. ..... 52/591.4
6,074,327 A * 6/2000 Franklin ..... 482/37
6,083,142 A * 7/2000 Wilson ..... 482/37
6,095,952 A * 8/2000 Ali et al. ..... 482/54
6,193,633 B1 * 2/2001 Jonas et al. ..... 482/35
6,231,482 B1 * 5/2001 Thompson ..... 482/37

* cited by examiner

*Primary Examiner*—Jerome W. Donnelly
*Assistant Examiner*—Lori Baker Amerson
(74) *Attorney, Agent, or Firm*—Browdy and Neimark, P.L.L.C.

(57) ABSTRACT

The invention is directed to an artificial climbing structure comprising panels (2) for making up an artificial wall (3), grips (4, 5) to be positioned on the panels (2), and attachment structure (6) for attaching the grips (4, 5) to the panels (2), each panel (2) having a plurality of engagement seats (7) for the grip attachment structure (6) to define a plurality of distinct positioning points to be selected at will for application of said grips (4, 5).

24 Claims, 10 Drawing Sheets

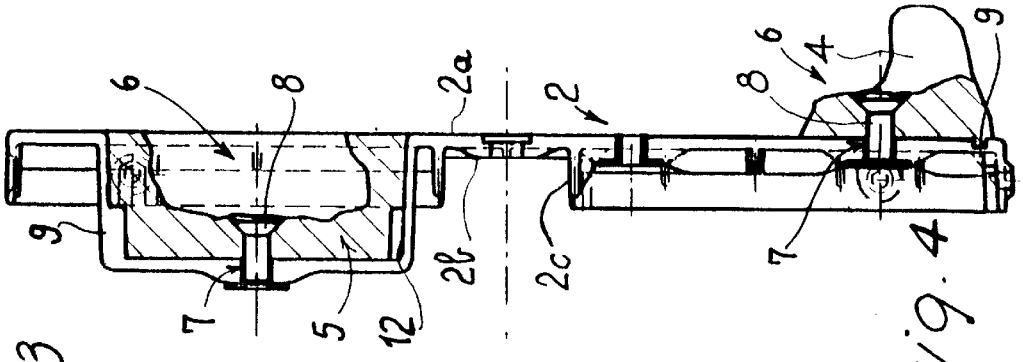
Fig. 3
Fig. 4
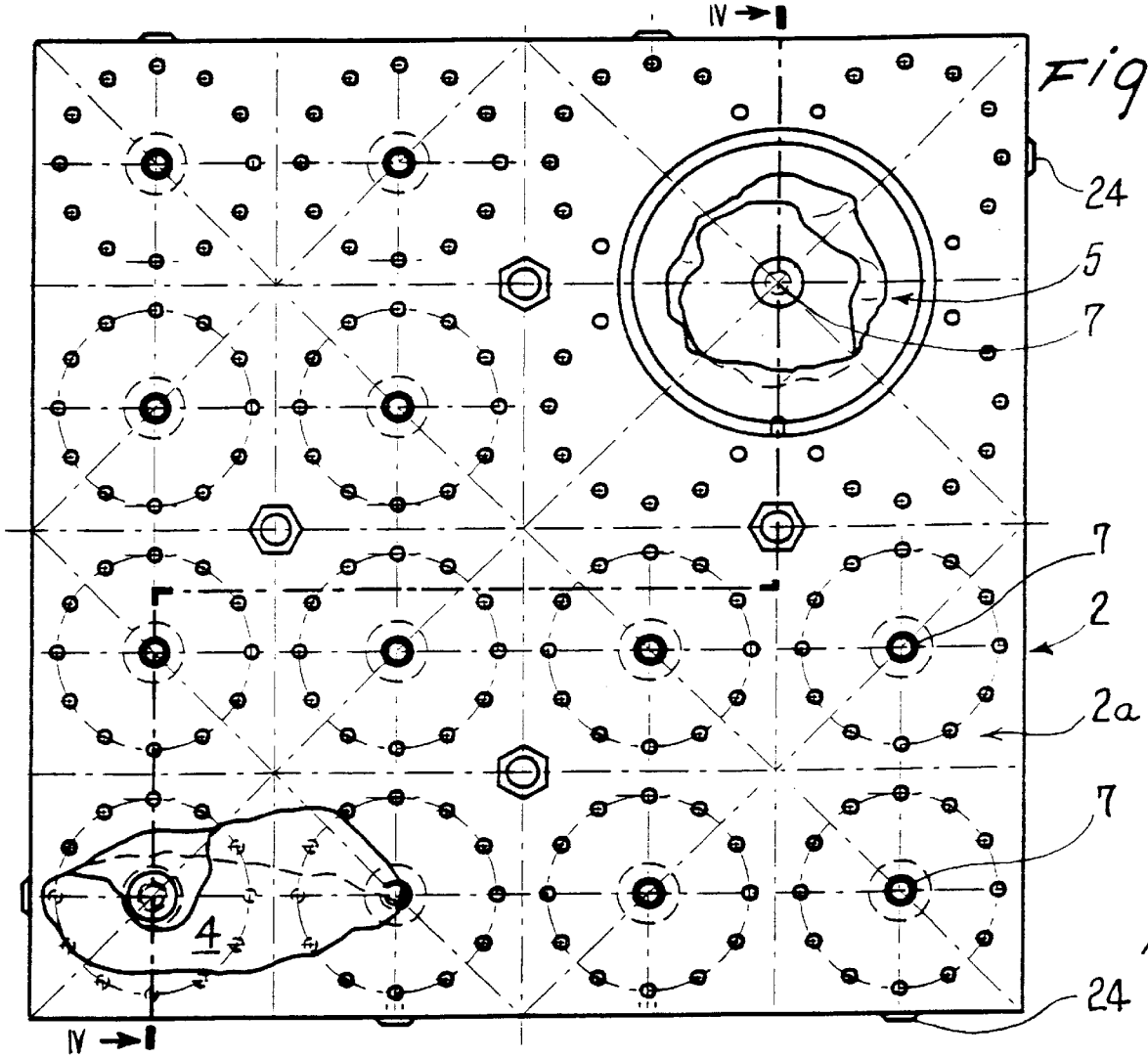

2
14
15
2c
15
22
23
2c
22
23
20
19
20
19
17
18
2c
2c
19
18
16
2

Fig.16a
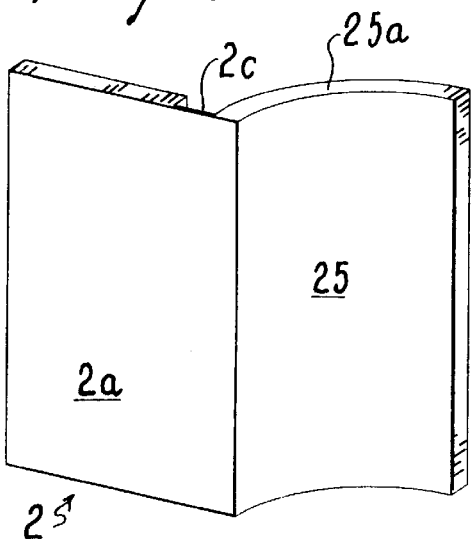
Fig.16b
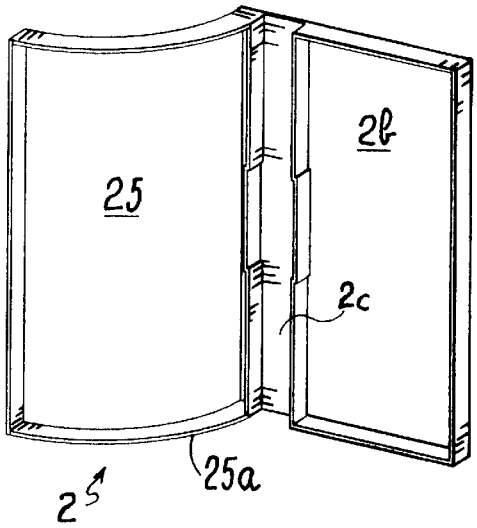
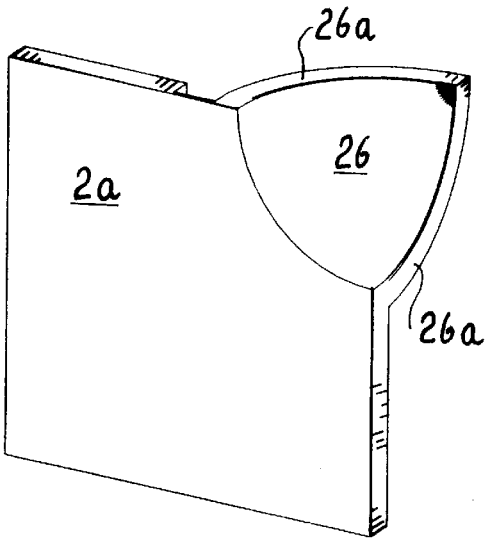
Fig.17a
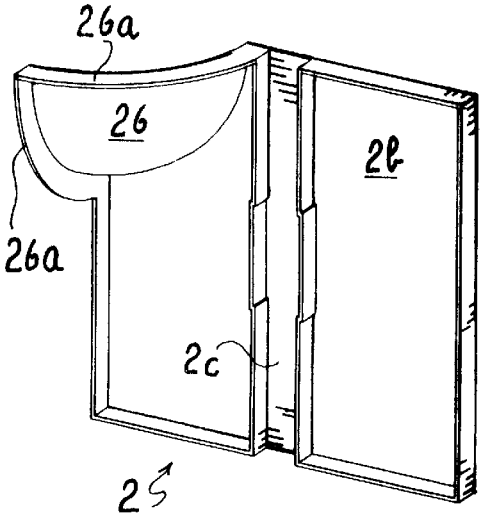
Fig.17b

Fig.18
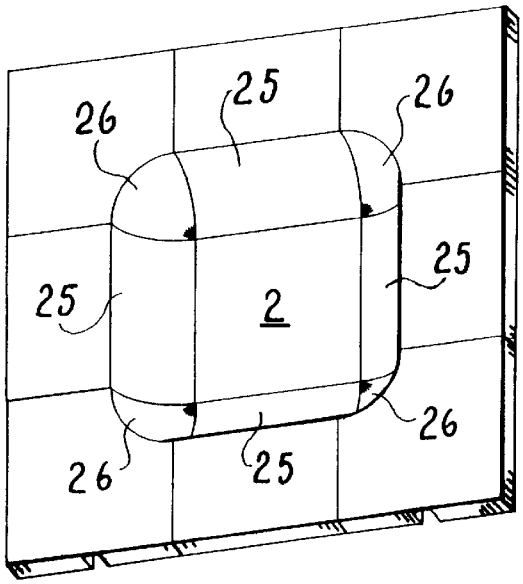
Fig.19
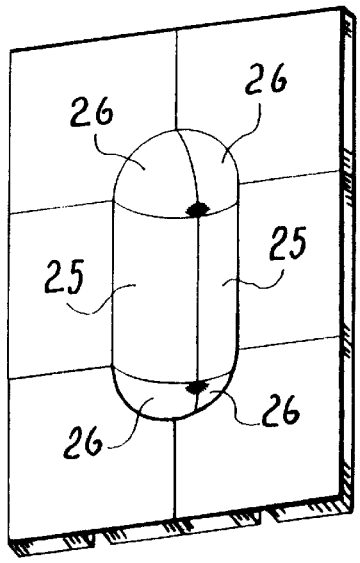
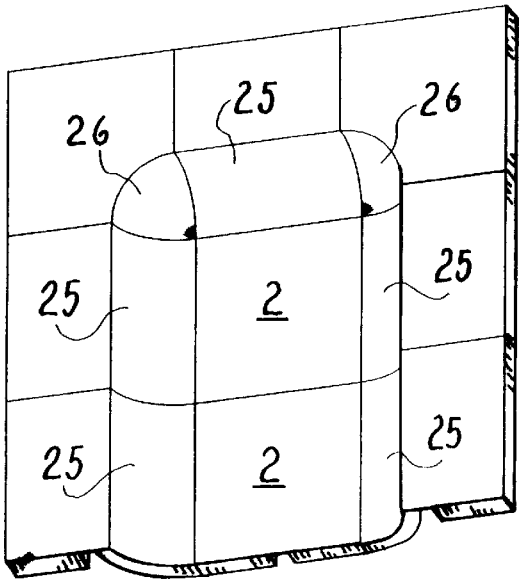
Fig.20
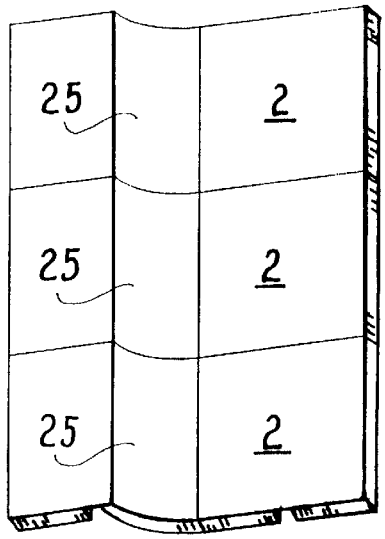
Fig.21

ARTIFICIAL CLIMBING STRUCTURE

FIELD OF THE INVENTION

The invention relates to an artificial climbing structure of the type comprising at least one panel defining at least one portion of artificial wall, at least one grip to be engaged with the panel, and means for attaching the grip to the panel.

DESCRIPTION OF THE PRIOR ART

It is known that climbing for sport can be carried out not only on natural rocks and stones, but also in indoor and outdoor environments utilizing artificial structures enabling climbing situations typical of the rock to be reproduced. The artificial structures of known type have an outer face or climbing wall which is, when mounted, made up of slabs provided with projecting or sunken grips. Said walls are supplied to those designed to carry out the installation operations in a condition either devoid of grips and pierced with holes at the grips to be applied or already provided with suitably arranged grips. Known artificial climbing structures have some limits and drawbacks. In fact, when grips are applied to and integrated into the climbing wall, the same are substantially fixed as regards positions, number and conformation, and substantially do not enable the climbing situations and problems to be changed in order to modify the degree of technical difficulty in climbing, unless specialized interventions and/or rearrangements involving manipulations are carried out. In addition, it should be pointed out that known artificial climbing structures are heavy and of arduous, expensive and unquick construction.

SUMMARY OF THE INVENTION

Under this situation the technical task underlying the invention is to devise an artificial climbing structure capable of obviating the mentioned drawbacks. Within the scope of this technical task it is an important aim of the invention to devise an artificial climbing structure offering the possibility of varying the climbing paths quickly, with ease, and at reduced costs so that the desired technical-difficulty degrees can be arranged with the greatest freedom. Another important aim of the invention is to devise a climbing structure to be accomplished within limited periods of time, at reduced costs, without particular technical difficulties and with a much lighter weight than structures of the traditional type.

The technical task mentioned and the aims specified are achieved by an artificial climbing structure comprising at least one panel defining at least one portion of an artificial wall, at least one grip to be engaged with said panel and means for attaching said grip to said panel, said panel being made of plastic material and comprising a plurality of engagement seats for said attachment means, said engagement seats defining a plurality of positioning points for said grip.

BRIEF DESCRIPTION OF THE DRAWINGS

The description of preferred embodiments of an artificial structure in accordance with the invention is now given with the aid of the accompanying drawings, in which:

FIG. 3 is a front view of a panel in accordance with the invention;

FIG. 4 is a section taken along line IV—IV in FIG. 3;

FIGS. 16*a,* 16*b* show a front and a rear view respectively of a first execution of a panel having a non-planar extension;

FIGS. 17*a,* 17*b* show a second execution of a panel having a non-planar extension, in the same manner as shown in FIGS. 16*a* and 16*b;*

FIG. 18 is a diagrammatic view of a first possible combination of the panels shown in FIGS. 16*a,* 16*b,* 17*a,* 17*b;*

FIG. 19 highlights a second possible combination of the panels shown in FIGS. 16*a,* 16*b,* 17*a,* 17*b;*

FIG. 20 highlights a third possible combination of the panels shown in FIGS. 16*a,* 16*b,* 17*a,* 17*b;* and FIG. 21 diagrammatically highlights a possible combination of the panels shown in FIGS. 16*a,* 16*b.*

DESCRIPTION OF THE PREFERRED EMBODIMENTS

Figure 1:
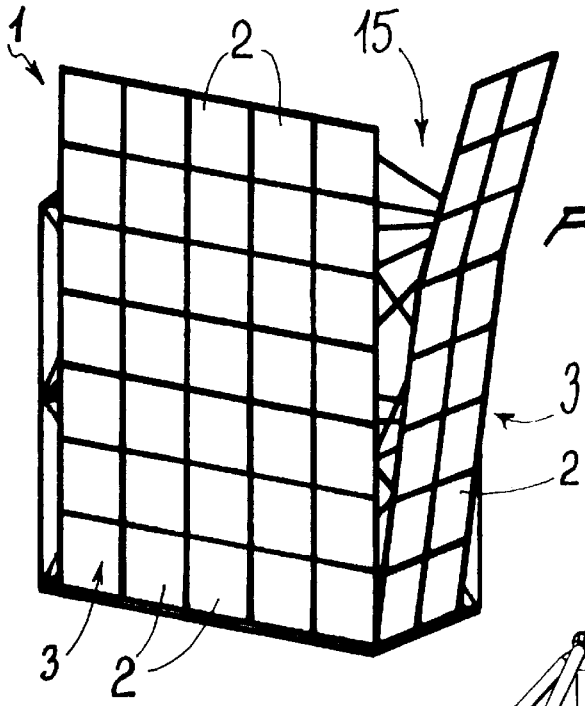
FIG. 1 is a diagrammatic overall view in perspective of an artificial climbing structure.

With reference to the drawings, the artificial climbing structure in accordance with the invention is generally identified by reference numeral 1.

It comprises a plurality of panels 2 of the modular type, designed to form an artificial wall 3, each of them being advantageously made of plastic material.

Preferably, the plastic material herein chosen is polyethylene terephthalate, shortly called PET or PEPT. It is a polyester made from ethylene glycol and terephthalic acid.

It is a plastic material that can have excellent mechanical features and high resistance to aging and weathering. It can be used in contact with foodstuffs and therefore ensures a complete non-toxicity.

Preferably, for the greatest environment respect, the used plastic material (PET) is of the recycled type.

The artificial climbing structure 1 has a plurality of grips that are both of the projecting 4 and the sunken 5 type to be positioned on panels 2, and means 6 for attaching the grips to the panels 2.

Such grips 4, 5 are preferably made of materials selected from epoxy resins and the above mentioned plastic material (PET) provided for panels 2.

Each panel 2 comprises a plurality of engagement seats 7 adapted to define a great number, or better the highest possible number, of distinct positioning points susceptible of being selected at will for application of the grips.

Figure 5:
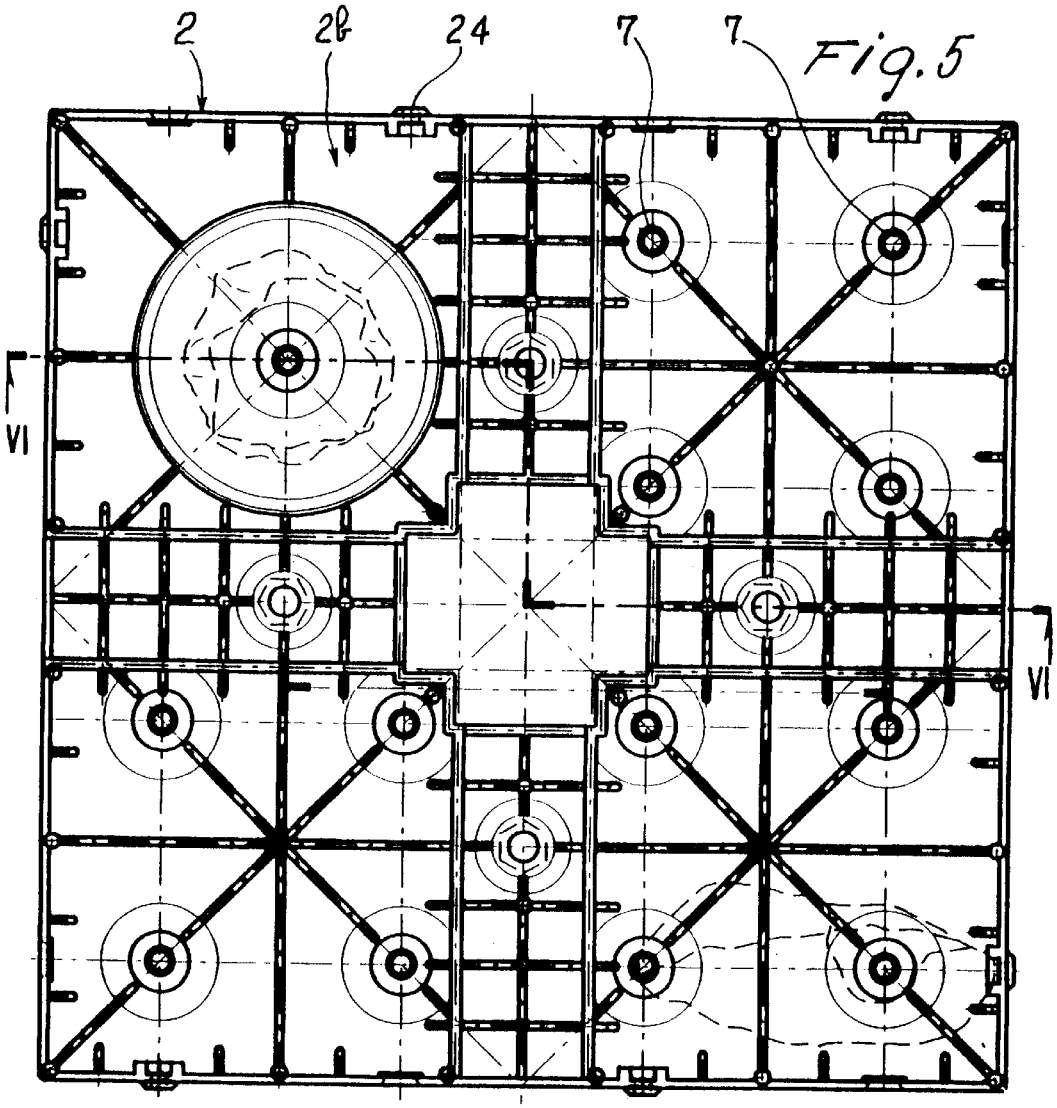
FIG. 5 is a rear view of the panel shown in FIG. 3.
Figure 7:
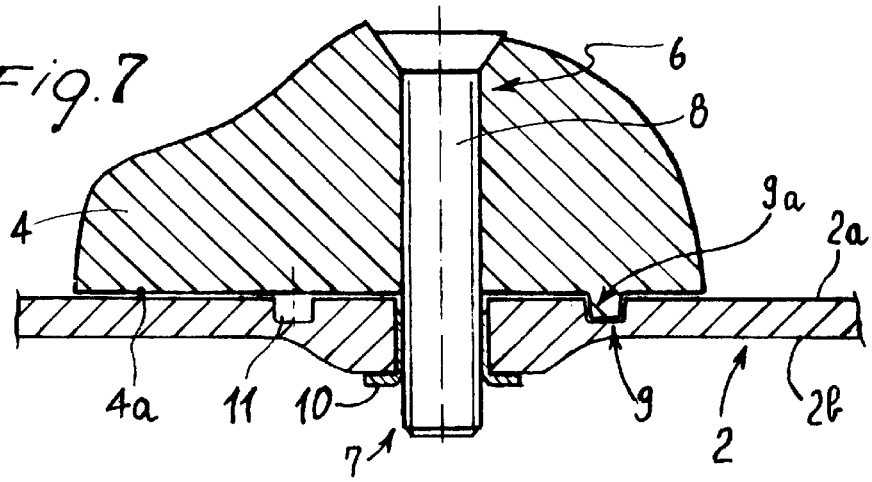
FIG. 7 shows an enlarged cross-section of a projecting grip and the means for attaching the same to a panel.
Figure 8:
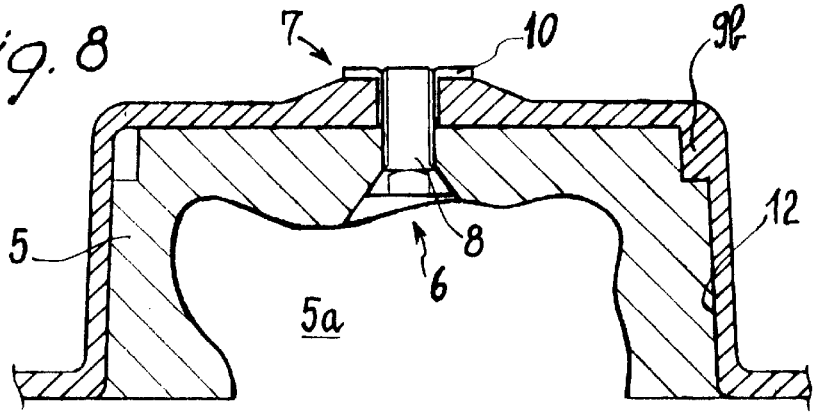
FIG. 8 is an enlarged cross-section of a sunken grip inserted in a cavity and the related attachment means.
Figure 9:
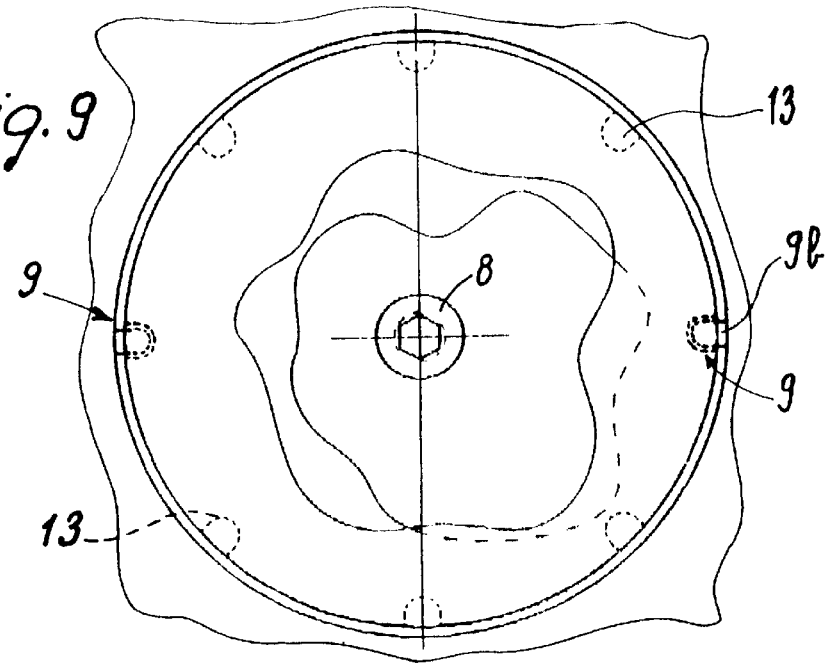
FIG. 9 is a bottom view of FIG. 8.

For instance, in the accompanying figures and in particular in FIGS. 3 and 5, twelve engagement seats for projecting grips 4 and one engagement seat for sunken grips 5 are provided.

The attachment means comprises, for each grip, a main attachment device 8 adapted to be removably coupled with an engagement seat 7 to firmly connect the corresponding grip to panel 2, and at least one auxiliary attachment device 9 interposed between the panel and the grip itself and adapted to block any angular orientation of same, i.e. to prevent any rotation of the grip on the panel even if the grip is submitted to very high stresses.

In more detail, each engagement seat 7 is defined by a through cavity formed in panel 2 and adapted to house a threaded bush 10 with which a screw defining the main attachment device 8 can be associated.

The auxiliary attachment device 9 in the case of projecting grips 4 is defined by an expansion like pawl 9*a* jutting out of a base face 4*a* of the grip, which face is designed to be turned towards the front climbing surface 2*a* of panel 2.

Said panel on said front surface 2*a* has a plurality of locking recesses or grooves 11 circumferentially disposed around each engagement seat 7 and each adapted to house a pawl 9*a*. In this way each projecting grip 4 can be fastened stably but in a removable manner, according to the desired orientation, through fitting of pawl 9*a* into the most appropriate locking groove 1 and screwing down of screw 8 tight.

In addition to the engagement seats 7 for the projecting grips 4, each panel 2 also has at least one cavity 12 adapted to house a sunken grip 5, i.e. a grip provided with a shaped recess 5*a*.

Said sunken grip 5 has a substantially frusto-conical outer conformation matching with the inner surface of cavity 12 that has a shape conforming to it.

In the same manner as described above for the external grips, the main attachment device 8 is defined by a screw to be coupled with a threaded bush 10 inserted in an engagement seat 7 formed at the bottom of cavity 12, and the auxiliary attachment device 9 is defined by one or more stop expansions 9*b* emerging from the surface of cavity 12 and adapted to be inserted into corresponding hollow seats 13 disposed externally of the sunken grip 5 and spaced apart the same distance from each other.

Figure 2:
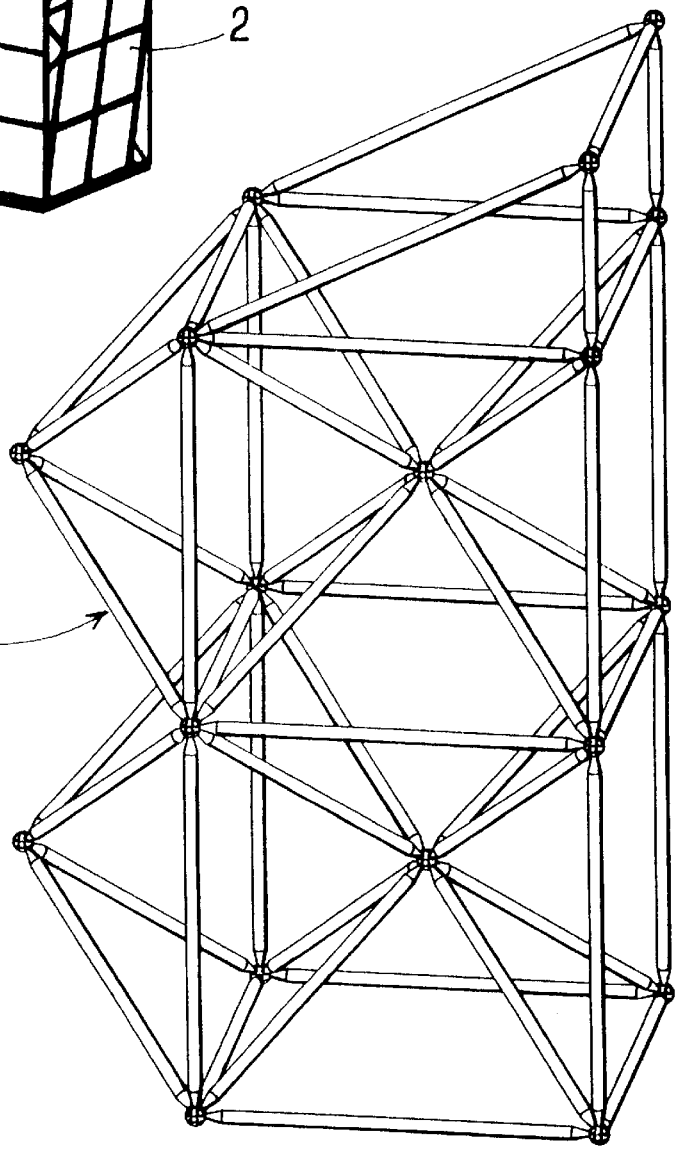
FIG. 2 is a perspective view of a main support structure inserted in the climbing structure in FIG. 1.
Figure 6:
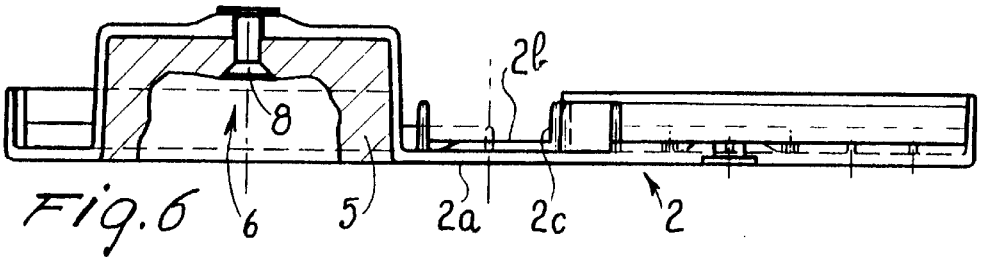
FIG. 6 is a section taken along line VI—VI in FIG. 5.

Thus, also for the sunken grips 5 the desired orientation can be established by inserting the stop expansions 9*a* into the most appropriate hollow seats 13. As shown in FIGS. 10 to 15, the artificial climbing structure 1 further comprises a support framework 14 for each modular panel 2 comprising a main support structure 15, a self-bearing tubular structure for example of the type shown in FIG. 2, and a stiffening structure 16 placed between panels 2 and the main support structure 15.

In fact panels 2 are purposely of reduced thickness so as to be light-in weight and adapted to be easily handled and for this reason the support framework 14 comprises a stiffening structure 16 for each panel 2 in engagement with the rear surface 2*b* of the panel.

The support framework 14 further comprises anchoring elements 17 adapted to fasten the stiffening structure 16 both to panel 2 and to the main support structure 15.

The stiffening structure 16 is in turn formed of bar elements 18, preferably made up of tubular elements of square section to be inserted into corresponding recessed guides 2*c* disposed on the rear faces 2*b* of panels 2. By giving the panel 2 a square shape, two recessed guides 2*c* can be provided that are disposed cross-wise and extend parallel to respective sides of the panel.

Figure 13:
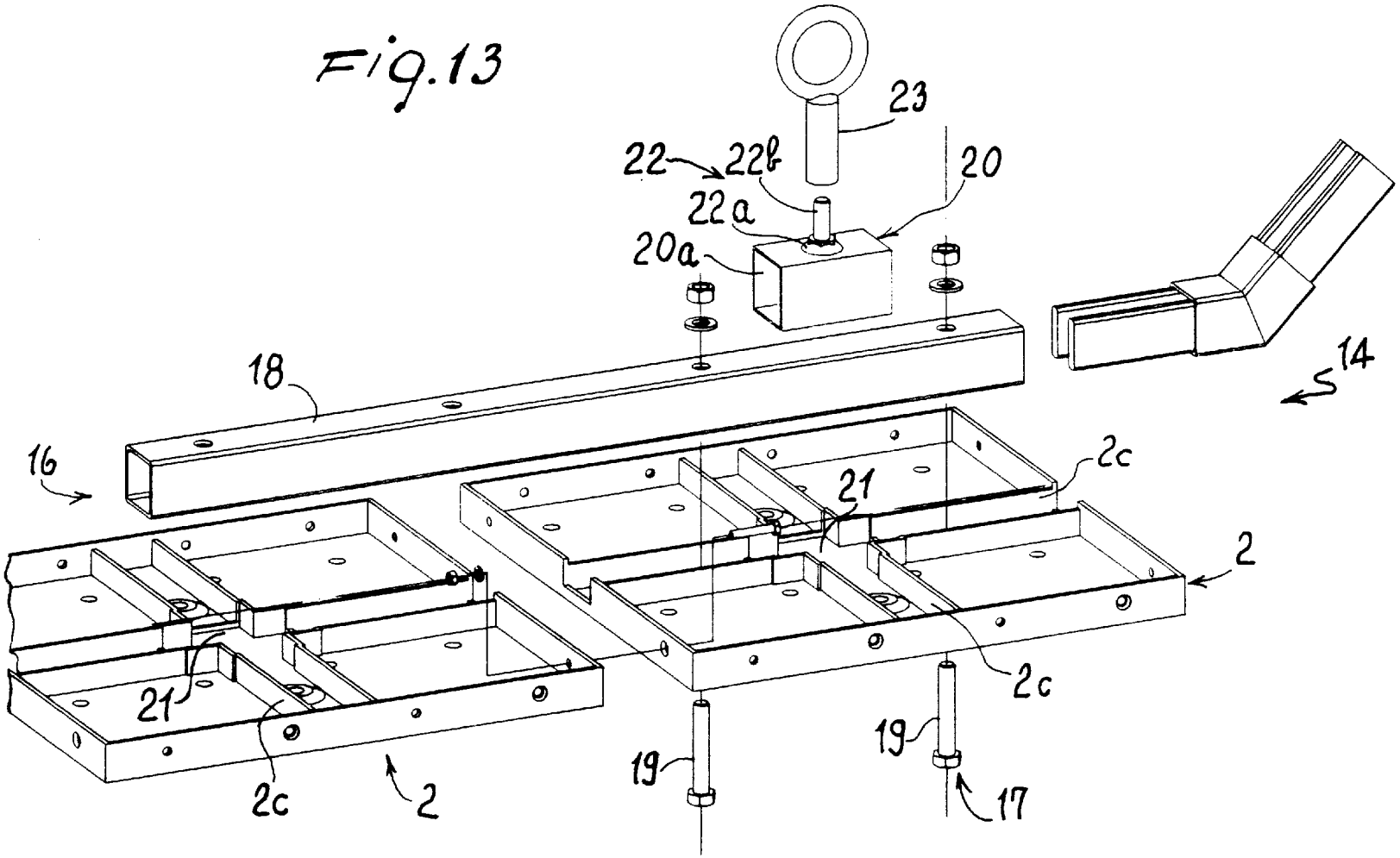
FIG. 13 is a perspective and exploded view of the stiffening structure.
Figure 14:
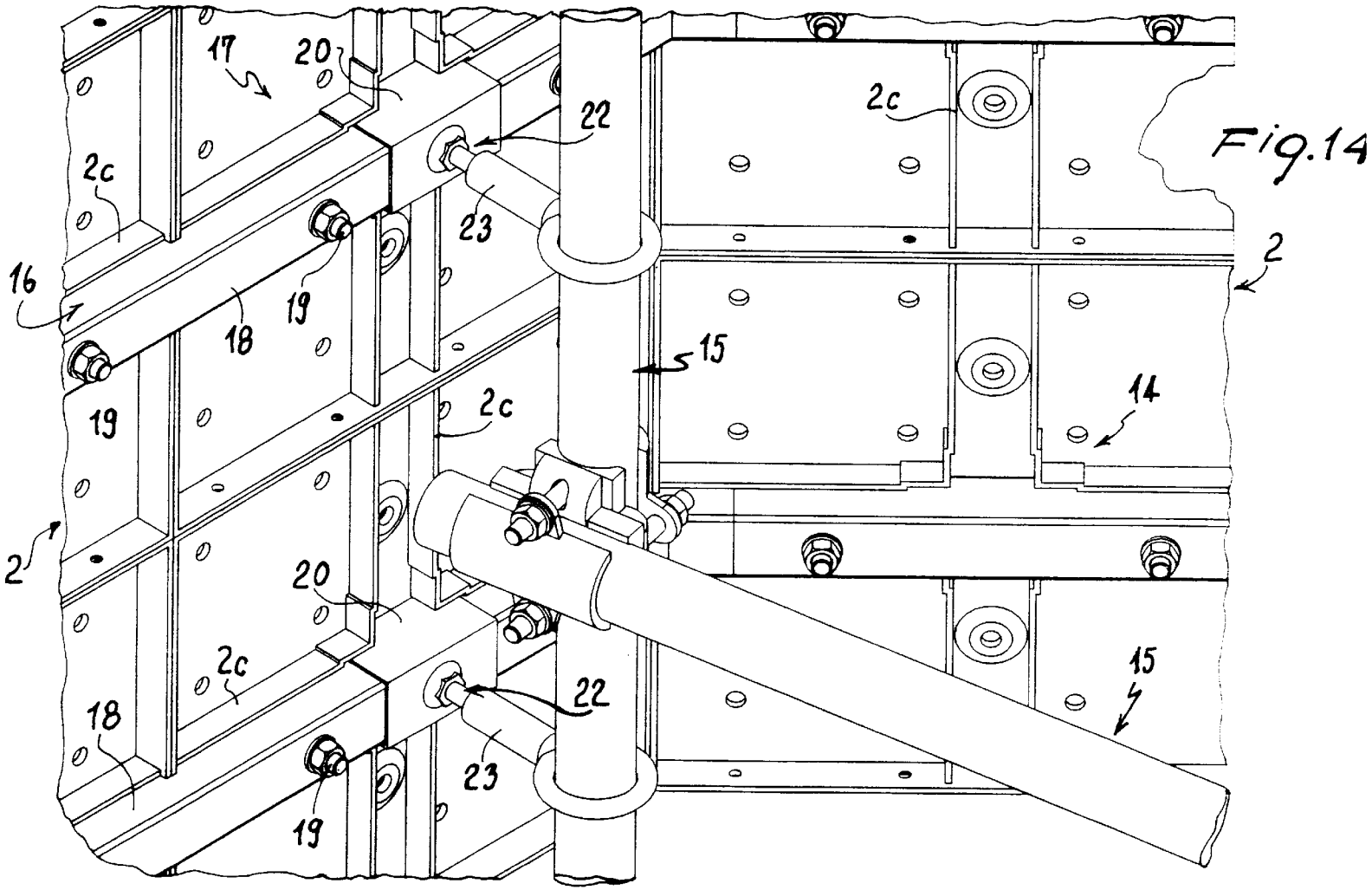
FIG. 14 shows how the panels engage with each other and with the main support structure.
Figure 15:
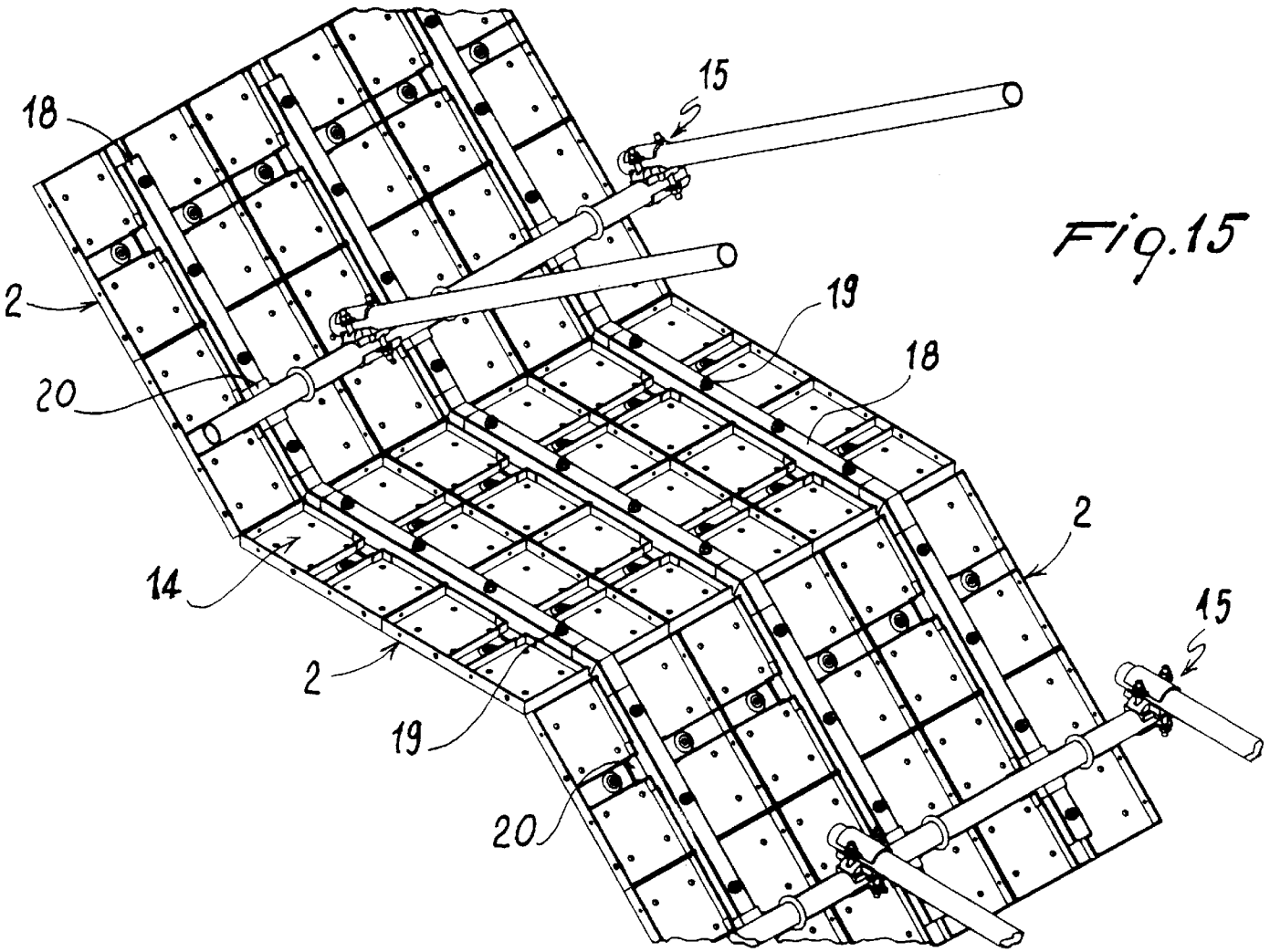
FIG. 15 is an overall perspective view similar to that in FIG. 14, but in a spread-out condition relative to the same.

In the embodiment shown in FIGS. 10, 11, 13, 14, 15 the anchoring elements 17 comprise first screw connection elements 19 adapted to fasten each bar element 18 to panel 2 and in addition they comprise a sleeve 20 in the form of a cross or a tube, and insertable in an intersection region 21 included between the two recessed guides 2*c*. Sleeve 20 when it is tube-shaped as in FIG. 13, is passed through by a first bar element 18.

Figure 10:
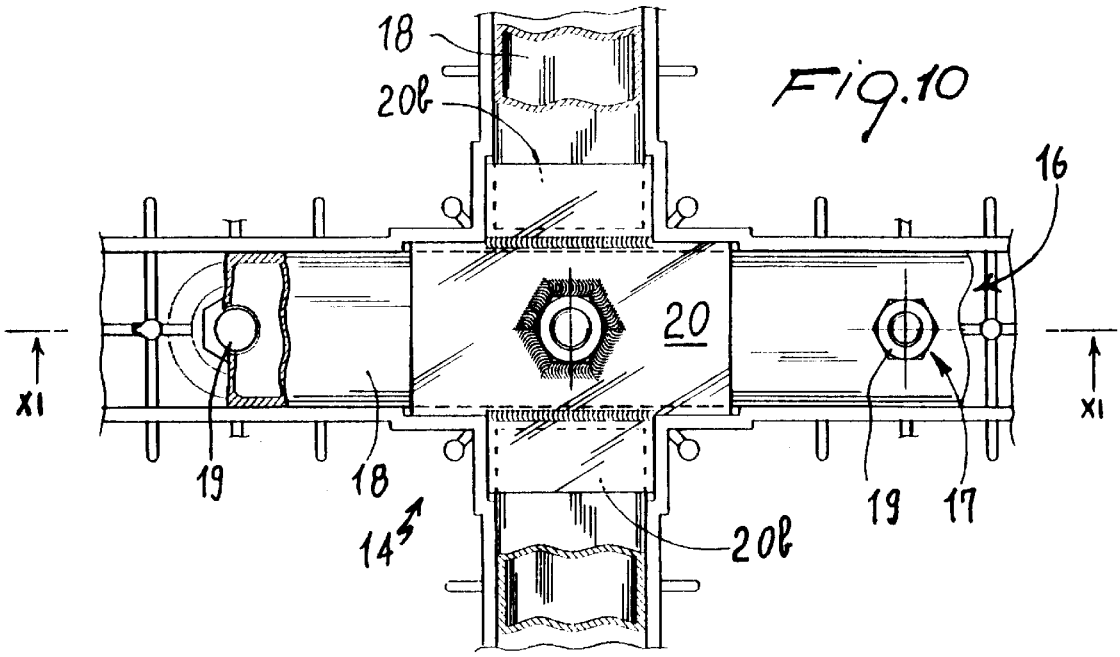
FIG. 10 diagrammatically shows a first execution of the stiffening structure of the panels.
Figure 11:
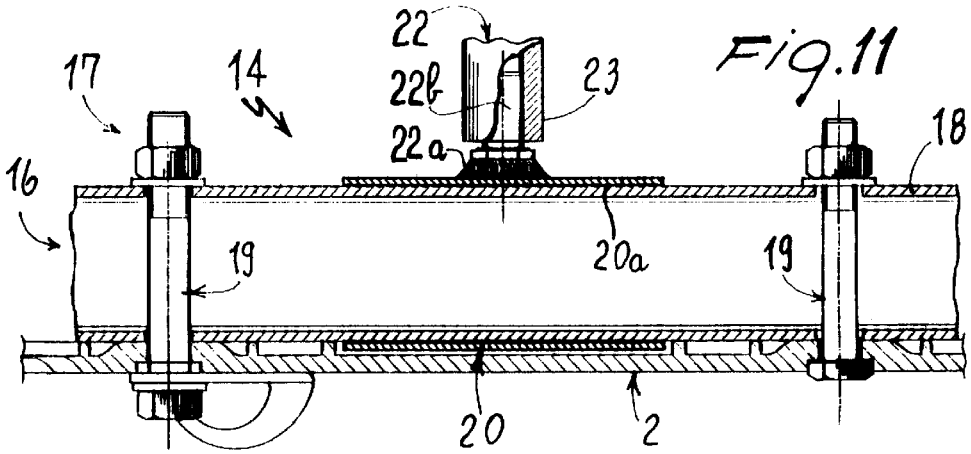
FIG. 11 is a section taken along the plane XI—XI in FIG. 10.

When on the contrary sleeve 20 is cross-shaped as in FIG. 10, it comprises, in addition to a through hole 20*a* passed through by a bar 18, also two side holes 20*b* adapted to house respective end portions of further bar elements 18 disposed in alignment with each other and transverse to the first bar element. Practically each bar element 18 has a longitudinal extension adapted to pass through two or more adjacent panels.

Rigid with sleeve 20 is a second screw connection element 22 having a head 22*a* welded to the sleeve 20 itself and a threaded shank 22*b* projecting from the rear surface 2*b* of panel 2.

The threaded shank 22*b* defines a hooking means for fastening to engagement elements 23 of the main support structure 15.

Figure 12:
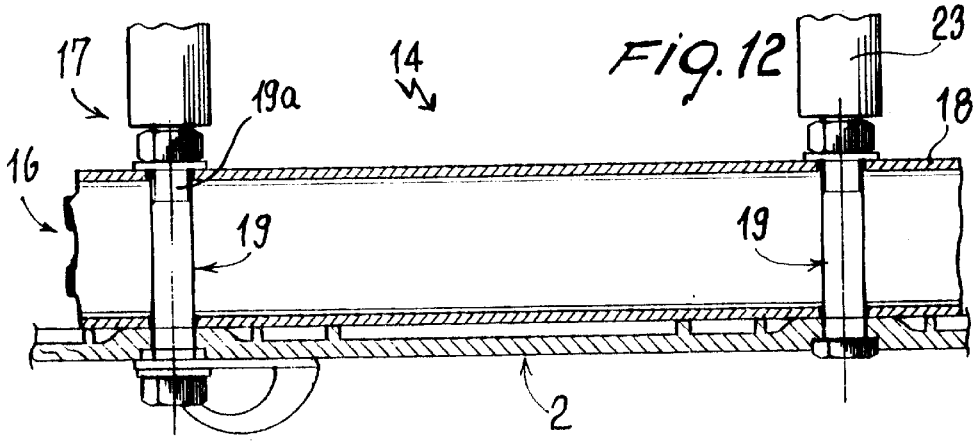
FIG. 12 shows a section similar to that in FIG. 11 of a second execution of the stiffening structure of the panels.

In the embodiment shown in FIG. 12 the anchoring elements 17 are made up of first screw connection elements 19 adapted to fasten the bar elements 18 to the panels and having threaded shanks 19*a* projecting transversely of the rear surface 2*b* of panel 2.

Such threaded shanks 19*a* are used as hooking means for fastening to the engagement elements 23 of the main support structure 15.

Finally, panel 2 of the modular type has side connection elements 24 adapted to be connected by close fit with corresponding side elements of other panels disposed in side by side relationship therewith.

In a further embodiment of the invention, deformed panels shown in FIGS. 16*a* to 21 are provided; they have deformed regions preferably in the form of depressions modifying the substantially planar extension of panels 2, at their edges.

The deformed regions are advantageously modular, i.e. they can be combined with each other so as to form walls with variously shaped wide deformations. Practically the deformed regions are edge regions and they only embody a segment of a wider deformation.

In particular, a first deformed panel is provided which is shown in FIGS. 16*a* and 16*b* and has a first deformed region 25 defining in its front surface 2*a*, a segment-shaped hollow of a cylindrical surface extending over the whole panel, between first opposite edge stretches 25*a* of the same.

Also provided is a second deformed panel, shown in FIGS. 17*a* and 17*b*, where a second deformed region 26 only engages a corner of the panel itself, extending however at the edges over second edge stretches 26*a* of the same length as that of the first edge stretches 25*a*.

The second deformed region 26 of the panel defines in its front surface 2*a*, a segment-shaped hollow of a spherical surface.

By combining the first and second deformed panels together and possibly also the substantially planar normal panels 2, at least at the edges, the shaped configurations shown in FIGS. 18 to 21 can be obtained. The invention achieves important advantages.

In fact, first of all, the assembled artificial wall formed of the panels in accordance with the invention is very versatile due both to the possibility of having a configuration in accordance with the shapes and sizes that are the most appropriate for any requirement and placement (thereby enabling accomplishment of teaching structures, practice walls, walls for displays and competitions), and to the positioning flexibility of the grips enabling the features of the technical climbing aspects to be modified each time.

It will be recognized in particular that the grips can not only be applied to the panels in a varying number and at points to be selected at will, but they can also be disposed at each positioning point with the orientation which is judged the most suitable.

It is important to emphasize the great amount of possible positions for the grips in a panel and the fact that said grips can be removed and inserted again in an easy manner and without resorting to specialized staff or to rearrangements in the panel structure.

Panels cannot be attacked by atmospheric agents and their strength features are steady in time.

It will be finally recognized that the modular panels forming the climbing wall are not particularly heavy as they are supported by a stiffening structure integrated thereinto and used for their connection to the main support structures.

Thus the manufacturing costs of said panels can be contained within limits due to the smaller amount of raw materials required and in conclusion the overall costs too for arrangement of the climbing walls can be reduced, also keeping into consideration the possibilities of partly varying the walls made up of the panels in accordance with the invention or fully dismantling and recombining them in different configurations.

What is claimed is:

1. An artificial climbing structure comprising:

at least one panel (2) defining at least one portion of an artificial wall (3), at least one grip (4, 5) engageable with said at least one panel (2), means (6) for attachment of said at least one grip (4, 5) to said at least one panel (2), said at least one panel (2) comprising a plurality of engagement seats (7) for said attachment means (6), said engagement seats (7) defining a plurality of positioning points for said at least one grip (4, 5), wherein said attachment means (6) comprise a main attachment device (8) extending between said at least one grip (4, 5) and one of said engagement seats (7) for removably supporting said at least one grip (4, 5), and an auxiliary attachment device (9) for blocking angular orientation of said at least one grip (4, 5) relative to said at least one panel (3), and wherein said auxiliary attachment device (9) comprises at least one expansion jutting out of said at least one grip (4, 5) and a plurality of locking recesses (11) circumferentially disposed around each of said engagement seats (7) each of said locking recesses (11) being adapted to house said at least one expansion.

2. An artificial climbing structure comprising:

at least one panel (2) defining at least one portion of an artificial wall (3), at least one grip (4, 5) engageable with said at least one panel (2), means (6) for attachment of said at least one grip (4, 5) to said at least one panel (2), said at least one panel (2) comprising a plurality of engagement seats (7) for said attachment means (6), said engagement seats (7) defining a plurality of positioning points for said at least one grip (4, 5), wherein said attachment means (6) comprise a main attachment device (8) extending between said at least one grip (4, 5) and one of said engagement seats (7) and adapted to removably support said at least one grip (4, 5), and an auxiliary attachment device (9) for blocking angular orientation of said at least one grip (4, 5) relative to said at least one panel (2), and wherein said auxiliary attachment device (9) comprises at least one stop expansion **(9*b*) emerging from said at least one panel (2) close to each of said engagement seats (7), and a plurality of hollow seats (13) formed in said at least one grip (4, 5) and disposed circumferentially of said main attachment device (8), each of said hollow seats (13) being adapted to house said at least one stop expansion (9*b*)**.

3. A structure as claimed in claim 1, wherein each of said engagement seats (7) comprises a through cavity and a threaded bush (10) adapted to be housed in said through cavity, and wherein said main attachment device (8) comprises a screw jutting out of said at least one grip (4, 5) and engageable with said threaded bush (10).

4. A structure as claimed in claim 2, wherein each of said engagement seats (7) comprises a through cavity and a threaded bush (10) adapted to be housed in said through cavity, and wherein said main attachment device (8) comprises a screw jutting out of said at least one grip (4, 5) and engageable with said threaded bush (10).

5. A structure as claimed in claim 1, wherein said at least one grip is a projecting grip (4) having a base face **(4*a*) for engagement with said at least one panel (2), and wherein said at least one expansion comprises at least one pawl (9*a*) jutting out of said base face (4*a*)**.

6. A structure as claimed in claim 1, wherein staid at least one panel (2) has at least one cavity (12), said at least one grip being a sunken grip (5) insertable in said at least one cavity (12).

7. A structure as claimed in claim 2, wherein said at least one panel (2) has at least one cavity (12), said at least one grip being a sunken grip (5) insertable in said at least one cavity (12), and wherein said at least one stop expansion **(9*b*) emerges from said at least one panel (2) at said at least one cavity (12)**.

8. A structure as claimed in claim 1, wherein said at least one panel (20 is a modular panel and has side connection elements **(2*d*) for removable fitting connection with corresponding of said side connection elements (2*d*) of at least another panel (2)**.

9. A structure as claimed in claim 2, wherein said at least one panel (20 is a modular panel and has side connection elements **(2*d*) for removable fitting connection with corresponding of said side connection elements (2*d*) of at least another panel (2)**.

10. A structure as claimed in claim 3, wherein said plastic material is PET (polyethylene terephthalate).

11. A structure as claimed in claim 3, wherein staid at least one grip (4, 5) is made of a material selected from epoxy resin and PET (polyethylene terephthalate).

12. A structure as claimed in claim 3, wherein said at least one panel (2) comprises a front climbing surface **(2*a*) and a rear surface (2*b*), and wherein said structure further comprises a support framework (14) and anchoring elements (17), said support framework (14) comprising a main support structure (15) and a stiffening structure (16), said stiffening structure (16) being engaged between said rear surface (2***b*) and said main support structure (15), said anchoring elements (17) fastening said stiffening structure (16) between said at least one panel (2) and said main support structure (15).

13. A structure as claimed in claim 2, wherein said at least one panel (2) comprises a front climbing surface (2*a*) and a rear surface (2*b*), and wherein said structure further comprises a support framework (14) and anchoring elements (17), said support framework (14) comprising a main support structure (15) and a stiffening structure (16), said stiffening structure (16) being engaged between said rear surface (2*b*) and said main support structure (15), said anchoring elements (17) fastening said stiffening structure (16) between said at least one panel (2) and said main support structure (15).

14. A structure as claimed in claim 12, wherein said stiffening structure (16) comprises at least one bar element (18) and wherein at least one said panel (2) has at least one recessed guide (2*c*) disposed on said rear surface (2*b*) and adapted to house said bar element (18).

15. A structure as claimed in claim 14, wherein said at least one panel (2) comprises two recessed guides (2*c*) defining an intersection region (21) centrally of said rear surface (2*b*), said recessed guides (2*c*) housing a plurality of said bar elements (18).

16. A structure as claimed in claim 15, wherein said anchoring elements (17) are defined by first screw connection elements (19) adapted to fasten each said bar elements (18) to said at least one panel (2), and having threaded shanks (19*a*) jutting out of said rear surface (2*b*) and defining hooking means for said main support structure (15).

17. A structure as claimed in claim 16, wherein each of said anchoring elements (17) further comprises a sleeve (20) insertable in said intersection region (21) and at least one second screw connection element (22) having a threaded shank (22*b*) jutting out of said sleeve (20) and defining a hooking means for said main support structure (15).

18. A structure as claimed in claim 1, wherein said at least one panel has at least one deformed region (25, 26) at an edge thereof, and wherein said at least one deformed region (25, 26) embodies a modular segment being part of a wider deformation to define, together with similar of said deformed regions (25, 26), a wider deformed area.

19. A structure as claimed in claim 2, wherein said at least one panel has at least one deformed region (25, 26) at an edge thereof, and wherein said at least one deformed region (25, 26) embodies a modular segment being part of a wider deformation to define, together with similar of said deformed regions (25, 26), a wider deformed area.

20. A structure as claimed in claim 18, wherein said at least one deformed region (25, 26) is a depression.

21. A structure as claimed in claim 20, wherein said at least one deformed region is a segment of a cylindrical surface (25).

22. A structure as claimed in claim 20, wherein said at least one deformed region is a segment of a spherical surface (26).

23. A structure as claimed in claim 1, wherein said at least one panel (2) is made of plastic material.

24. A structure as claimed in claim 2, wherein said at least one panel (2) is made of plastic material.

* * * * *